US011519374B2

(12) United States Patent
Gartung et al.

(10) Patent No.: US 11,519,374 B2
(45) Date of Patent: Dec. 6, 2022

(54) INJECTOR HAVING A TRIPARTITE VALVE SEAT

(71) Applicant: Robert Bosch GmbH, Stuttgart (DE)

(72) Inventors: Kai Gartung, Stuttgart (DE); Matthias Lausch, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 25 days.

(21) Appl. No.: 16/461,817

(22) PCT Filed: Sep. 27, 2017

(86) PCT No.: PCT/EP2017/074455

§ 371 (c)(1),
(2) Date: May 17, 2019

(87) PCT Pub. No.: WO2018/091184

PCT Pub. Date: May 24, 2018

(65) Prior Publication Data

US 2019/0323468 A1 Oct. 24, 2019

(30) Foreign Application Priority Data

Nov. 21, 2016 (DE) ..... 102016222908.7

(51) Int. Cl.
*F02M 61/18* (2006.01)
*B05B 1/30* (2006.01)

(52) U.S. Cl.
CPC ..... *F02M 61/1853* (2013.01); *B05B 1/3013* (2013.01); *F02M 2200/03* (2013.01); *F02M 2200/8061* (2013.01); *F02M 2200/8084* (2013.01)

(58) Field of Classification Search
CPC ..... F02M 61/1583; F02M 61/186; F02M 2200/03; F02M 2200/8061; F02M 2200/8084; B05B 1/3013
See application file for complete search history.

(56) References Cited

U.S. PATENT DOCUMENTS 5,263,648 A * 11/1993 Vogt ..... F02M 51/0682 239/533.14
6,264,112 B1 7/2001 Landschoot et al.
(Continued)

FOREIGN PATENT DOCUMENTS

CN 1118181 A 3/1996
DE 631135 C 6/1936
(Continued)

OTHER PUBLICATIONS

International Search Report for PCT/EP2017/074455, dated Jan. 5, 2018.

*Primary Examiner* — Steven M Cernoch
(74) *Attorney, Agent, or Firm* — Norton Rose Fulbright US LLP; Gerard Messina

(57) ABSTRACT

An injector for injecting a fluid includes a base body having an opening and a sealing seat, a spray-orifice disk having at least one spray orifice, and a clamping ring, the spray-orifice disk being disposed in the opening of the base body, and a first nonpositive connection is provided between the spray-orifice disk and the base body, and a second nonpositive connection is provided between the base body and the clamping ring.

10 Claims, 3 Drawing Sheets

(56) References Cited

U.S. PATENT DOCUMENTS

| | | | | |
|---|---|---|---|---|
| 6,273,349 | B1 * | 8/2001 | Fischbach | F02M 61/1853 239/585.1 |
| 7,370,816 | B2 * | 5/2008 | Kumagai | F02M 61/1853 239/533.12 |
| 2002/0060257 | A1 * | 5/2002 | Yuan | F02M 61/162 239/585.1 |
| 2007/0095949 | A1 | 5/2007 | Kumagai et al. | |

FOREIGN PATENT DOCUMENTS

| | | | |
|---|---|---|---|
| DE | 10025331 | A1 | 12/2000 |
| DE | 102006017006 | A1 | 5/2007 |
| DE | 112013000923 | T5 | 10/2014 |
| DE | 102014211494 | A1 | 12/2015 |
| DE | 102015201109 | A1 | 7/2016 |
| EP | 1757800 | A1 | 2/2007 |
| JP | H112168 | A | 1/1999 |
| JP | 2004360477 | A | 12/2004 |
| WO | 2007091536 | A1 | 8/2007 |

* cited by examiner

INJECTOR HAVING A TRIPARTITE VALVE SEAT

FIELD OF THE INVENTION

The present invention relates to an injector for the injection of a fluid, in particular a fuel, the injector having a tripartite valve seat; the present invention also relates to an internal combustion engine.

BACKGROUND INFORMATION

Injectors of different designs for the injection of fuel are known from the related art. Known, for example, are what are termed multi-hole nozzles in which a plurality of spray orifices are provided in a single-piece base body. Alternatively, injectors having a base body on which a spray-orifice disk is held in place are known from the printed publication German Published Patent Application No. 10 2015 201 109, for instance. The securing is realized by welding. This results in a positive connection between the base body and the spray-orifice disk. However, because of this positive connection, tensile stresses are introduced into the spray-orifice region during an operation on account of the internal pressure and a needle impact during the closing of the injector. The spray-orifice region must therefore also assume a supporting function in addition to the spray formation function. In the process, tensile stresses occur in the region of the spray orifices, in particular, which can lead to tears at the spray orifices and thus may have a negative effect on the spray formation and the tightness of the injector. In order to avoid this, the spray-orifice disks can currently be configured only with great limitations as far as a required wall thickness in the spray-orifice region or a geometrical form of the spray orifice is concerned, for instance. It would therefore be desirable to have an injector available that does not have any such restrictions in the configuration of the spray orifices, so that the spray orifices are able to be individually configured for different internal combustion engines for an optimum spray formation in an effort to optimize the consumption and the emissions, in particular.

SUMMARY

In contrast, the injector according to the present invention for the injection of a fluid, in particular for the injection of fuel into an internal combustion engine, has the advantage that a spray-orifice disk and, in particular the spray-orifice geometry of the spray-orifice disk, is able to be configured as desired without having to take restrictions into account that are defined by a needle impact or the like, for example. According to the present invention, this is achieved by providing the injector with a tripartite valve seat. The injector includes a base body having an opening and a sealing seat, a spray-orifice disk and a clamping ring. At least one spray orifice is situated in the spray-orifice disk. The spray-orifice disk sits in the opening of the base body, and a first nonpositive connection is present between the spray-orifice disk and the base body, without a positive connection being provided in this first connection. Furthermore, a second nonpositive connection exists between the base body and the clamping ring, without a positive connection being provided between the clamping ring and the base body. The spray-orifice disk may thus be individually configured, and a securing is realized merely by a frictional connection rather than an intermaterial connection such as with the aid of a welded connection or the like, as in the related art. This also applies to the second nonpositive connection between the base body and the clamping ring. The base body thus serves as a support both for the spray-orifice disk and the clamping ring. The base body itself may then be connected, for instance using a positive connection, to a further injector component, in particular a valve sleeve or the like. Since the sealing seat is situated on the base body and since no positive connection exists between the spray-orifice disk and the base body, it can be ruled out that the needle impact on the sealing seat leads to tensile stresses in the spray-orifice disk. With the aid of the design principle according to the present invention, a decoupling in terms of structure mechanics is therefore achievable between the spray-orifice disk and the base body. Thus, the spray-orifice disk is now only exposed to stressing by an internal pressure of the fluid, in particular the fuel, and is subjected solely to compression stresses. Due to the second nonpositive connection between the clamping ring and the base body, the clamping ring consequently exerts a radially inwardly directed force, which also acts on the first connection between the base body and the spray-orifice disk. Thus, a particularly pressure-tight connection, which does not involve a positive connection, is able to be achieved between the base body and the spray-orifice disk. Vibrational stressing of the spray-orifice disk by tensile stresses as they occur in the related art in a positive connection between the spray-orifice disk and the base body is significantly reduced or may also be completely avoided.

The clamping ring and the spray-orifice disk are preferably placed in such a way that a plane that runs at a right angle to a center axis X-X of the injector intersects both the spray-orifice disk and the clamping ring.

The base body preferably has a step, which is provided on its outer circumference and accommodates the clamping ring.

In a furthermore preferred manner, a thickness of the clamping ring equals a thickness of the spray-orifice disk. The clamping ring and the spray-orifice disk are preferably disposed at the same height in axial direction X-X of the injector so that the entire clamping force of the clamping ring is acting also on the first connection between the spray-orifice disk and the base body.

The number of parts of the injector is able to be reduced if a guide region for the needle guidance is preferably situated on the base body in addition. The needle guidance is used for guiding a valve needle or the like, which provides sealing at the sealing seat of the base body and thereby releases or seals the spray orifices in the spray-orifice disk.

The opening in the base body in which the spray-orifice disk is situated is preferably tapered and has a conical development, in particular. The outer circumferential contour of the spray-orifice disk is developed to complement the geometry of the opening in the base body. Alternatively, the opening in the base body has a cylindrical shape and the outer circumference of the spray-orifice disk is also cylindrical.

In addition, it is preferred that an outer contour of the spray-orifice disk, which lies at an outer side of the injector, has a concave or convex form. This offers the special advantage that an optimal outer contour of the spray-orifice disk may be selected as a function of the position of the injector in an internal combustion engine or directly in a combustion chamber or in a placement in an intake manifold or in some other position in the internal combustion engine, without the need to take strength demands into account as in the related art in the case of a positive connection between the spray-orifice disk and the base body.

Another essential advantage of the present invention is that a different material may be provided for each component for the tripartite valve seat. This allows for an optimal adaptation of the materials to the respective requirements without having to consider whether or not the materials are able to be positively joined to one another, such as by welding.

In addition, a welding region is preferably provided on the base body for the connection of the base body to a further injector component, in particular a valve sleeve.

According to one further preferred embodiment of the present invention, the spray-orifice disk has a step at the outer circumference on an exit side. Because of the provided step, the contact surface, and thus the contact press-fit, may be configured/adjusted independently of the wall thickness of the spray-orifice disk. Alternatively or additionally, a bevel on the spray-orifice disk or on the base element would also be an option.

The spray orifices in the spray-orifice disk are preferably cylindrical or provided with a prestep or extend in a tapered fashion. It should be noted that the geometry of the spray orifices is selectable as desired.

In addition, the present invention pertains to an internal combustion engine having an injector according to the present invention. In an especially preferred manner, the injector is configured for the injection of fuel, in particular gasoline.

DETAILED DESCRIPTION

In the following text, an injector 1 according to a first preferred exemplary embodiment of the present invention will be described in detail with reference to FIGS. 1 and 2.

Figure 1:
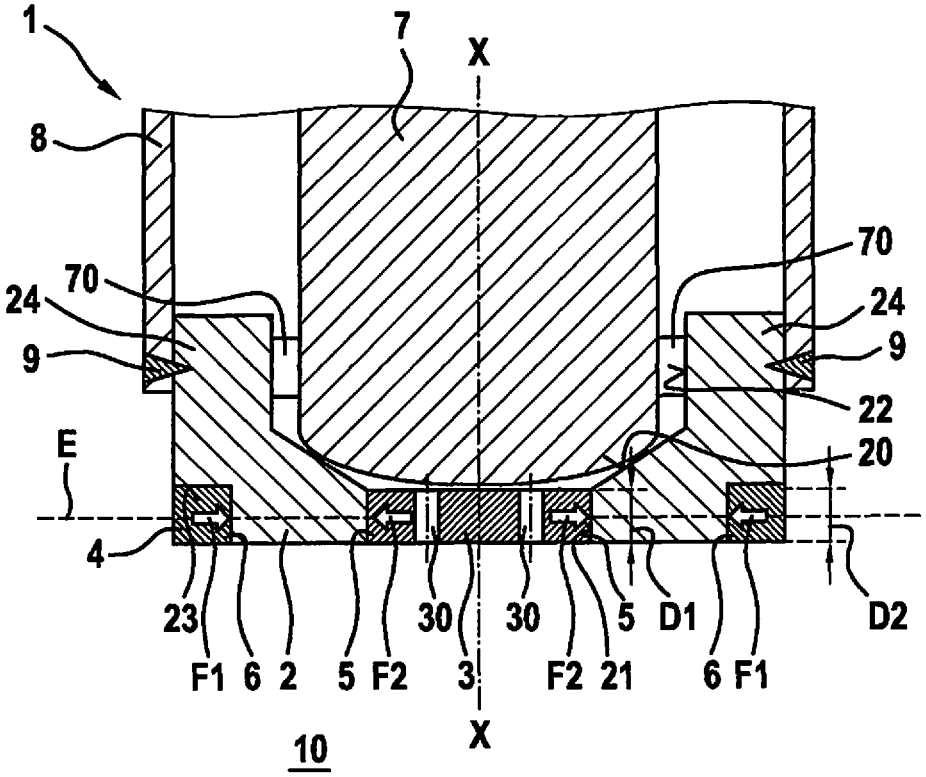
FIG. 1 shows a schematic sectional view of an injector according to a first exemplary embodiment of the present invention.

As may be gathered from FIG. 1, injector 1 includes a tripartite valve seat, which includes a base body 2, a spray-orifice disk 3 and a clamping ring 4.

In addition, the injector includes a valve needle 7 and a valve sleeve 8. Base body 2 is connected to valve sleeve 8 with the aid of a welded connection 9.

In addition, base body 2 has a central opening 21, in which spray-orifice disk 3 is accommodated.

A first nonpositive connection 5 is provided between base body 2 and spray-orifice disk 3. Moreover, a second nonpositive connection 6 is provided between base element 2 and clamping ring 4.

In addition, a sealing seat 20 is developed on base body 2, where valve needle 7 provides sealing or opens spray orifices 30, which are disposed in spray-orifice disk 3, so that fuel is able to be injected via spray orifices 30 into a combustion chamber 10.

Furthermore, a guide region 22, which is aligned parallel to an axial direction X-X of the injector, is provided on base body 2. Guide region 22 serves as guidance for valve needle 7. Toward this end, valve needle 7 has a plurality of guide elements 70. Fuel is able to flow through to spray-orifice disk 3 between individual guide elements 70. Alternatively, it is also possible to use a cylindrical needle without guide elements. The guide elements must then lie in the base body.

As illustrated in FIG. 1, base body 2 furthermore has a step 23, which accommodates clamping ring 4. Step 23 is developed in such a way that clamping ring 4 is fully able to be placed on base body 2 without projecting.

A welding region 24 of base element 2 is used for an affixation on valve sleeve 8.

Figure 2:
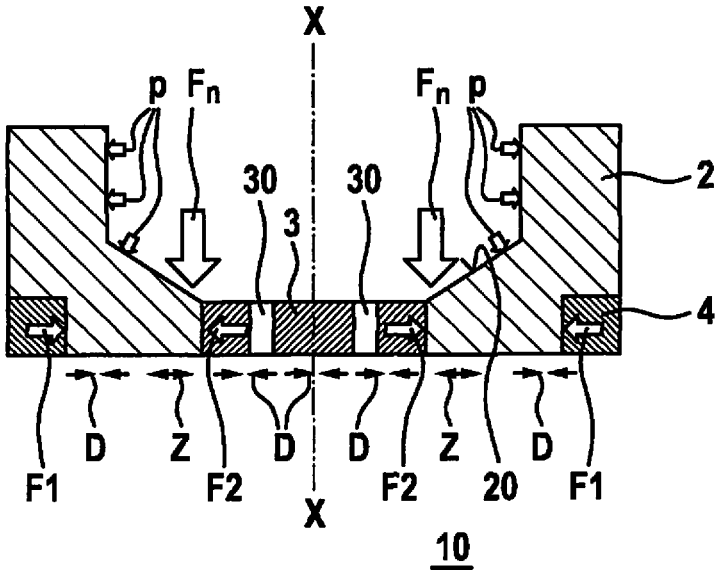
FIG. 2 shows a schematic sectional view, which illustrates the force distribution at the tripartite sealing seat.

As may be gathered from FIGS. 1 and 2, a radially inwardly directed clamping force F1 is now exerted by second nonpositive connection 6 between clamping ring 4 and base body 2. This produces a counter force F2 at first nonpositive connection 5 between spray-orifice disk 3 and base body 2. The first and second nonpositive connections 5, 6 are realized by press-fit connections. Due to first clamping force F1, base body 2 is thus elastically compressed radially within clamping ring 4 so that spray-orifice disk 3 sits in opening 21 in base element 2 in a pressure-tight manner.

Since no positive connection is provided between spray-orifice disk 3 and base body 2, it can be ruled out that a needle impact of valve needle 7 causes tensile stresses in spray-orifice disk 3. This may be gathered in detail from FIG. 2. In the course of the closing process, valve needle 7 strikes sealing seat 20 on base body 2. This does not stress spray-orifice disk 3. As schematically illustrated in FIG. 2, smaller tensile stresses Z arise on base body 2 due to the needle impact, which, however, do not occur in spray-orifice disk 3. Due to the radially inwardly directed forces, spray-orifice disk 3 is subjected only to compression stresses D but not to tensile stresses Z. This is schematically illustrated in FIG. 2.

In the open state of the injector, only forces of fuel pressure p are acting on spray-orifice disk 3. In the closed state, no fuel pressures p are acting on spray-orifice disk 3.

The present invention fundamentally differs in this point and does so very advantageously in comparison with the related art. On account of the design principle of providing a tripartite component, which is connected only via nonpositive connections 5, 6, a decoupling in terms of structural mechanics is realized for spray-orifice disk 3. The force of the needle impact of valve needle 7 is completely absorbed via the solidly developed base element 2. When the valve is open, spray-orifice disk 3 is thus subjected only to fuel pressure p. Vibrational stresses, which cause tensile stresses in spray-orifice disk 3 on account of the needle impact, and possible bouncers or the like, are decisively minimized or eliminated.

Thus, when configuring spray-orifice disk 3, it is very advantageously possible, for example, to provide a smaller wall thickness between adjacent spray orifices 30 than in the related art. This allows for shorter spray orifices and thus for a further improved mixture formation with advantages in terms of consumption and emissions.

In addition, the present invention also allows for the higher system pressures that are required by future generations of internal combustion engines in view of increasing demands on the service life. The spray-orifice design is therefore no longer hampered by restrictions that previously existed for stability-related reasons.

In addition, the material of spray-orifice disk 3 may also be selected to differ from the material of base body 2 and from the material of clamping ring 4. For instance, a material that has an excellent welding tendency may be selected for base body 2 in order to allow for a connection of the tripartite valve seat to a valve sleeve 8 or a housing or the like. For spray-orifice 3, for instance, an easily machinable material is selectable. The target conflicts in the material selection that currently exist in the related art with regard to a required vibration resistance of the valve seat and a corrosion resistance of the spray-orifice disk are avoided.

As illustrated in FIG. 1, a first thickness D1 of the spray-orifice disk equals a second thickness D2 of clamping ring 4. This makes it possible to use the entire outer circumferential area of spray-orifice disk 3 for the force introduction that is exerted by the clamping force of clamping ring 4 in the radially inward direction. As further illustrated in FIG. 1, spray-orifice disk 3 and clamping ring 4 are situated on a shared plane E, which runs at a right angle to axial direction X-X.

FIGS. 3 through 6 show further preferred embodiments of the present invention.

Figure 3:
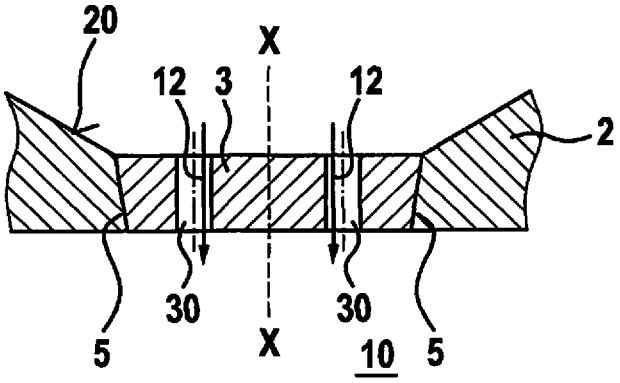
FIGS. 3 to 6 show different exemplary embodiments of different nonpositive connections between a base body and a spray-orifice disk.

In FIG. 3, first nonpositive connection 5 is provided, which has a tapered geometrical development. First nonpositive connection 5 tapers in the direction of through-flow 12 through spray-orifice disk 3. Spray orifices 30 have a cylindrical shape. However, the spray orifices may also have a conical development. In addition, a combination of spray orifice and pre-step bore is possible.

Figure 4:
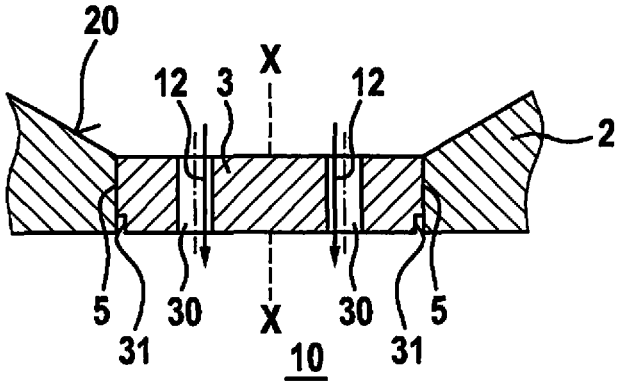

In the development illustrated in FIG. 4, first nonpositive connection 5 is developed in cylindrical form. Spray-orifice disk 3 has an offset 31 at an end oriented in the direction of combustion chamber 10. A force introduction of the nonpositive connection during the assembly is thereby distributed to a smaller area with the aid of clamping ring 4.

Figure 5:
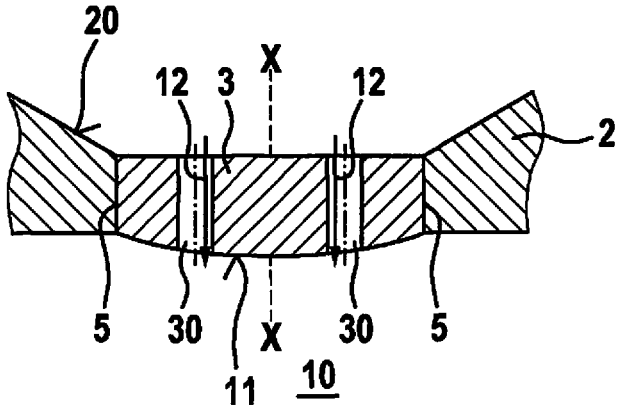

FIG. 5 shows an embodiment in which an area 11 of spray-orifice disk 3 pointing to combustion chamber 10 has a concave development.

Figure 6:
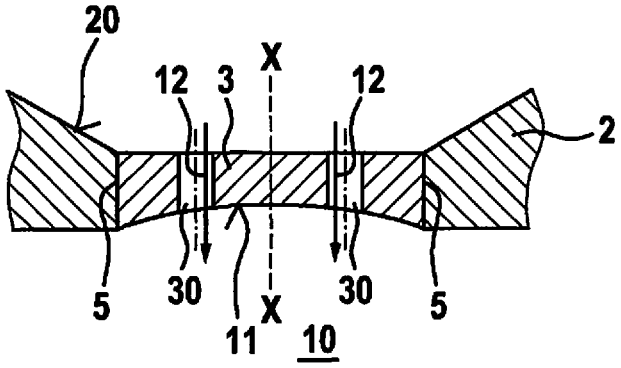

FIG. 6 shows a development in which an area 11 of spray-orifice disk 3 pointing to combustion chamber 10 has a convex development. As shown in all exemplary embodiments, it is therefore possible to provide a tripartite valve seat including a base body 2, a spray-orifice disk 3 and a clamping ring 4. During an operation of the injector, only compression stresses D but no tensile stresses Z are generated in the spray-orifice disk. Clamping ring 4, which is situated at the outer circumference of base body 2, generates an additional clamping force at first nonpositive connection 5 in order to realize a pressure-tight placement of spray-orifice disk 3 in base body 2.

What is claimed is:

1. An injector for injecting a fluid, comprising:
- a base body having an opening and a sealing seat;
- a spray-orifice disk having at least one spray orifice; and
- a clamping ring, wherein:
  - the spray-orifice disk is situated in the opening of the base body,
  - a first press-fit connection is present between the spray-orifice disk and the base body, and
  - a second press-fit connection is present between the base body and the clamping ring,
- wherein a radially inwardly directed clamping force is exerted by the second press-fit connection between the clamping ring and the base body,
- wherein the base body is elastically compressed radially within the clamping ring so that the spray-orifice disk sits in the opening in the base body in a pressure-tight manner,
- wherein the first press-fit connection and the second press-fit connection are positioned in such a way that a plane that runs at a right angle to a center axis of the injector intersects the first press-fit connection and the second press-fit connection,
- wherein a thickness of the spray-orifice disk equals a thickness of the clamping ring, and the clamping ring and the spray-orifice disk are disposed at a same height and situated on the plane that runs at a right angle to the center axis of the injector such that a top end portion of the clamping ring and a top end portion of the spray-orifice disk terminate a same distance away from a bottom of the injector where the fluid is injected.

2. The injector as recited in claim 1, wherein the spray-orifice disk and the clamping ring are positioned in such a way that the plane intersects the spray-orifice disk and the clamping ring.

3. The injector as recited in claim 1, wherein the base body includes a step in order to accommodate the clamping ring.

4. The injector as recited in claim 1, further comprising a guide region disposed on the base body, the guide region being adapted to guide a valve needle.

5. The injector as recited in claim 1, wherein the opening in the base body has a tapered development in order to provide the first press-fit connection in tapered form.

6. The injector as recited in claim 1, wherein the opening in the base body is cylindrical in order to provide the first press-fit connection with a cylindrical form between the base body and the spray-orifice disk.

7. The injector as recited in claim 1, wherein an area of the spray-orifice disk pointing to a combustion chamber has one of a concave development and a convex development.

8. The injector as recited in claim 1, wherein the base body and the spray-orifice disk are produced from different materials.

9. The injector as recited in claim 1, wherein the base body has a welding region adapted to provide a welded connection to a further component of the injector.

10. An internal combustion engine, comprising:
- an injector for injecting a fluid, the injector including:
  - a base body having an opening and a sealing seat;
  - a spray-orifice disk having at least one spray orifice; and
  - a clamping ring, wherein:
  - the spray-orifice disk is situated in the opening of the base body,
  - a first press-fit connection is present between the spray-orifice disk and the base body, and
  - a second press-fit connection is present between the base body and the clamping ring,
- wherein a radially inwardly directed clamping force is exerted by the second press-fit connection between the clamping ring and the base body,
- wherein the base body is elastically compressed radially within the clamping ring so that the spray-orifice disk sits in the opening in the base body in a pressure-tight manner,
- wherein the first press-fit connection and the second press-fit connection are positioned in such a way that a plane that runs at a right angle to a center axis of the injector intersects the first press-fit connection and the second press-fit connection,
- wherein a thickness of the spray-orifice disk equals a thickness of the clamping ring, and the clamping ring and the spray-orifice disk are disposed at a same height and situated on the plane that runs at a right angle to the center axis of the injector such that a top end portion of the clamping ring and a top end portion of the spray-orifice disk terminate a same distance away from a bottom of the injector where the fluid is injected.

* * * * *